US006070663A

United States Patent [19]

Cernocky et al.

[11] Patent Number: 6,070,663

[45] Date of Patent: Jun. 6, 2000

[54] MULTI-ZONE PROFILE CONTROL

[75] Inventors: Edward Paul Cernocky, Sugar Land; Robert Lance Cook, Katy; Frank Joseph Schuh, Plano, all of Tex.

[73] Assignee: Shell Oil Company, Houston, Tex.

[21] Appl. No.: 09/080,330

[22] Filed: May 15, 1998

Related U.S. Application Data

[60] Provisional application No. 60/050,084, Jun. 16, 1997.

[51] Int. Cl.[7] ..... E21B 43/24

[52] U.S. Cl. ..... 166/272.3; 166/242.2; 166/242.3; 166/313; 166/306

[58] Field of Search ..... 166/272.3, 258, 166/269, 306, 313, 242.3

[56] References Cited

U.S. PATENT DOCUMENTS

| | | | |
|---|---|---|---|
| 3,180,413 | 4/1965 | Willman | 166/11 |
| 3,741,306 | 6/1973 | Rapadopoulos et al. | 166/306 X |
| 3,975,912 | 8/1976 | Greene | 60/641 |
| 3,983,939 | 10/1976 | Brown et al. | 166/269 |
| 4,116,275 | 9/1978 | Butler et al. | 166/303 |
| 4,248,302 | 2/1981 | Churchman | 166/272 |
| 4,424,859 | 1/1984 | Sims et al. | 166/67 |
| 4,460,044 | 7/1984 | Porter | 166/252 |
| 4,566,536 | 1/1986 | Holmes | 166/251 |
| 4,582,132 | 4/1986 | Anderson et al. | 166/75 |
| 4,595,057 | 6/1986 | Deming et al. | 166/269 |
| 4,617,995 | 10/1986 | Lau | 166/272 |
| 4,640,355 | 2/1987 | Hong et al. | 166/269 |
| 4,648,455 | 3/1987 | Luke | 166/242.2 X |
| 4,678,039 | 7/1987 | Rivas et al. | 166/272.3 X |
| 4,687,057 | 8/1987 | Moore et al. | 166/272.3 X |
| 4,766,958 | 8/1988 | Faecke | 166/269 |
| 4,793,414 | 12/1988 | Nguyen et al. | 166/252 |
| 4,986,352 | 1/1991 | Alameddine | 166/263 |
| 4,988,389 | 1/1991 | Adamache et al. | 166/304 X |
| 5,014,787 | 5/1991 | Duerksen | 166/303 |
| 5,024,275 | 6/1991 | Anderson et al. | 166/303 |
| 5,044,436 | 9/1991 | Magnani | 166/247 |
| 5,085,275 | 2/1992 | Gondouin | 166/303 |
| 5,085,276 | 2/1992 | Rias et al. | 166/303 |
| 5,161,613 | 11/1992 | Jones | 166/242.3 |
| 5,238,066 | 8/1993 | Beattie et al. | 166/303 |
| 5,409,071 | 4/1995 | Wellington et al. | 166/253 |
| 5,433,271 | 7/1995 | Vinegar et al. | 166/272.1 |

FOREIGN PATENT DOCUMENTS

| | | | |
|---|---|---|---|
| 1235652 | 4/1988 | Canada | 166/21 |
| 2031813 | 6/1991 | Canada | 166/39 |
| 1230385 | 12/1966 | Germany . | |

*Primary Examiner*—Roger Schoeppel
*Attorney, Agent, or Firm*—Beverlee G. Steinberg

[57] ABSTRACT

There is a provided an apparatus and process for multi-zone profile control in a well including a wellbore intersecting at least one production zone, at least one injection tube, at least one insulation means, and at least one zone isolation means. Control media is injected through the injection tube, exiting at at least one control media exit of the injection tube and entering the production zone. The insulation means allow multiple zones to be injected simultaneously with control media of different temperatures and pressures.

62 Claims, 5 Drawing Sheets

MULTI-ZONE PROFILE CONTROL

This application claims benefit of Provisional Application Ser. No. 60/050,084 filed Jun. 16, 1997.

FIELD OF THE INVENTION

This invention relates to single and multi-zone profile control, particularly profile control in a well for production of fluids.

BACKGROUND OF THE INVENTION

Zone profile control in wells is typically accomplished by injecting media into production zones. For example, high pressure and temperature steam is injected into production zones containing hydrocarbon fluids to drive the fluids to a desired wellbore. Injection is commonly done through injection strings. However, prior art processes and apparatus are limited to the amount of injection strings that can be placed in a well, thereby requiring multiple injection wells to be drilled for multiple zone control.

Under current practices, multiple strings may be run successively but not concurrently. Another limitation is that all the injection fluids placed in a particular well have to be injected at one common pressure and temperature, limited to the minimum temperature and pressure of the commingled zones. This reduces the efficiency of the injection process, as production of a multi-zone formation is best maximized by injection of control media at a different temperature and pressure for each zone, dependent upon the properties of the fluid in that zone.

SUMMARY OF THE INVENTION

It is an object of the invention to provide an apparatus which allows simultaneous placement of multiple injection strings in a single well, including a well which is being repaired and/or converted from a production well to an injection well.

It is further an object of the invention to provide an apparatus which allows simultaneous delivery of control media at independently controlled temperatures and pressures to each production zone.

Therefore, there is provided an apparatus for zone profile control in a well, comprising:

a wellbore intersecting a production zone;

an injection tube within said wellbore, said injection tube having an outside surface, an inside surface defining a injection annulus, at least one control media exit, and a longitudinal axis parallel to a longitudinal axis of the wellbore; and an insulation means having a longitudinal axis parallel to the longitudinal axis of the wellbore, said insulation means surrounding said injection tube;

wherein at least one control media exit of said injection tube is adjacent to said production zone; and wherein control media is injected through said injection annulus, said control media exiting said injection annulus at at least one control media exit of said injection tube, said control media further having access to the production zone.

In another embodiment of the invention there is provided an apparatus for multi-zone profile control in a well, comprising:

a wellbore intersecting at least one production zone;

a first casing within said first wellbore, said first casing having an outside surface, an inside surface defining an insulation annulus, and a longitudinal axis parallel to a longitudinal axis of said wellbore;

a plurality of injection tubes within said first casing, each said injection tube having an outside surface, an inside surface defining a injection annulus, at least one control media exit adjacent to a production zone, and a longitudinal axis parallel to the longitudinal axis of said first casing; and an insulation media within said insulation annulus, said insulation media surrounding said injection tubes;

wherein control media is injected through the injection annulus of at least one of said plurality of injection tubes, said control media exiting said injection annulus at at least one control media exit of said at least one injection tube, said control media further having access to the production zone adjacent to said at least one control media exit.

There is also provided a process for zone profile control of a well, comprising:

selecting a formation having a production zone;

selecting a first wellbore intersecting said production zone;

selecting a second wellbore intersecting said production zones;

injecting control media into said first wellbore through injection apparatus, wherein said injection apparatus comprises a casing within said first wellbore, said casing having an inside surface, and a longitudinal axis parallel to a longitudinal axis of said first wellbore, an injection tube within said casing, said injection tube having an outside surface, an inside surface defining a injection annulus, at least one control media exit adjacent to a production zone, and a longitudinal axis parallel to the longitudinal axis of the casing, wherein the inside surface of said casing and the outside surface of said injection tube define an insulation annulus and wherein said control media is carried in said injection annulus and exiting at at least one control media exit, and at least one zone isolation means within said insulation annulus, each said zone isolation means effective in preventing control media flow into the insulation annulus;

passing said control media through said injection apparatus into the production zone; and recovering production fluids from said second wellbore.

Another process embodiment provides for multi-zone profile control of a well, comprising:

selecting a formation having at least one production zone;

selecting a first wellbore intersecting at least one of said at least one production zones;

selecting a second wellbore intersecting at least one of said at least one production zones;

injecting control media into said first wellbore through injection apparatus, wherein said injection apparatus comprises a plurality of casing within said first wellbore, each said casing having an inside surface, at least one first control media exit, and a longitudinal axis parallel to a longitudinal axis of said first wellbore, a plurality of injection tubes, each said injection tube having an outside surface, an inside surface defining a injection annulus, at least one second control media exit, and a longitudinal axis parallel to the longitudinal axis of said first wellbore, wherein said control media is carried in said injection annulus and exiting at at least one second control media exit, wherein each injection tube is positioned within a casing thereby forming a plurality of casing/tubing pairs whereby for each casing/tubing pair the inside surface of said casing and the outside surface of said injection tube define an insulation annulus, wherein at least one second control media exit of each said injection tube is near at least one first control media exit of its paired casing and adjacent to a production zone, an insulation media within each said insulation annulus, and at least one zone isolation means within each said insulation annulus, each said zone isolation means effective in preventing control media flow into the insulation annulus;

passing said control media through said injection apparatus into the production zones adjacent to each of said injection tubes; and recovering production fluids from said second wellbore.

DETAILED DESCRIPTION

Apparatus and methods are provided for zone profile control in a well, in particular for injection of a control media into multiple zones of a well. Conventional tubing, or preferably coiled tubing, are used to provide small diameter tubing and casing systems to simultaneously inject two, three, four or five different geological zones in any single well with a control media. The temperature and pressure of the control media to each zone can be separately maintained, so that delivery is best tailored to each zone. This is possible because the control media sent to each zone is isolated from other control media by use of insulating gaps, such as air gaps or low-conductivity cement or low-conductivity epoxy.

The apparatus and process will work well for any control media, such as steam or electronic or dry heat, and any production fluid. Since a common control media used is steam to control and enhance production of hydrocarbons, this will be used for purposes of illustration below.

Figure 1B:
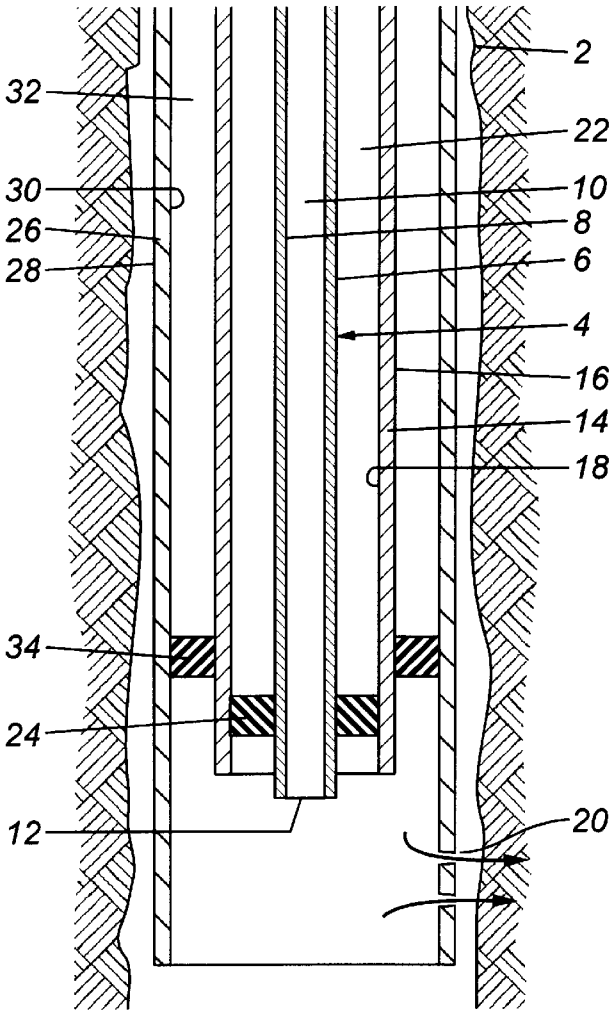
FIG. 1*b* shows a variation of the apparatus of FIG. 1*a*.
Figure 1A:
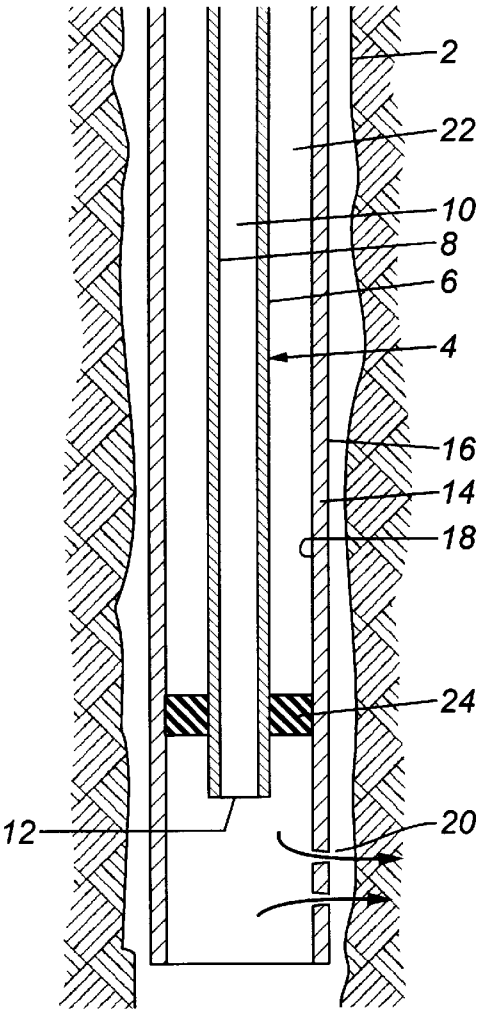
FIG. 1*a* is a cross-sectional view of an apparatus for zone profile control of a well.

Referring to FIG. 1*a*, in a first embodiment, an apparatus is provided for single zone profile control in a well. The apparatus comprises a wellbore 2 intersecting a production zone; an injection tube 4 within the wellbore and having an outside surface 6, an inside surface 8 defining a injection annulus 10, at least one first control media exit 12, and a longitudinal axis parallel to a longitudinal axis of the wellbore; and an insulation means having a longitudinal axis parallel to the longitudinal axis of the wellbore, the insulation means surrounding the injection tube 4. In most instances, the insulation means will be a first casing 14 having an outside surface 16, an inside surface 18, and at least one second control media exit 20. The inside surface 18 of the casing 14 and the outside surface 6 of the injection tube 4 define an insulation annulus 22. The insulation means is most easily filled with air, although other gases, fluids, or insulating materials can be used. The insulation means also includes at least one zone isolation means 24 positioned within the insulation annulus near each at least one control media exit of the injection tube.

Each first control media exit 12 of the injection tube 4 is positioned to be adjacent to a production zone (shown as flow arrows in all the Figures). The control media, such as steam, is injected through the injection annulus 10 and exits the injection annulus at a first control media exit of the injection tube, where the control media has access to enter the production zone, usually through at least one second control media exit. A control media exit may be an open bottom of a tube or casing, or a perforated area of a tube or casing, both types of which are depicted in the Figures.

The isolation zone 24 means may be anything which is effective in preventing control media flow into the insulation annulus. Preferably the isolation zone means is selected from a packer, a nipple, a mandrel, or combinations thereof Although conventional tubing can be used in the apparatus, the use of coiled tubing allows single and multiple-injection zone injection apparatus with very small diameters, which are economically competitive, and without need for threaded connections which would serve as possible leak sources and possible heat loss points along each string and facilitates simultaneous placement of multiple tubing strings into a single wellbore. In the embodiment shown in FIG. 1*a*, the injection tube may be coiled tubing having an outside diameter no greater than about 5.1 cm (2 inches), preferably in the range of 2.5–3.2 cm (1–1¼ inch), and the casing may be coiled tubing having an outside diameter no greater than about 8.9 cm (3.5 inches), preferably 2.5 cm (2 inch).

The embodiment of FIG. 1*a* just described is most useful for a newly drilled injection well. With only slight changes, the embodiment can also be used to convert an existing well to an injection well, as shown in FIG. 1*b*. The apparatus described above is placed inside a second casing 26, which already exits in the wellbore. The second casing has an outside surface 28, an inside surface 30, and a longitudinal axis parallel to the longitudinal axis of the wellbore. The inside surface 30 of the second casing and the outside surface 16 of the first casing define a casing annulus 32. At least one second zone isolation means 34 is also provided, positioned in the casing annulus 32 near at least one second control media exit 20 of the first casing, the second zone isolation means effective in preventing flow of control media into the casing annulus. The second isolation means is also selected from a packer, a nipple, a mandrel, or combinations thereof The casing annulus may be filled with cement. At least one second control media exit 20 of the first casing and at least one first control media exit 12 of the injection tube 4 are adjacent to the production zone and the second casing is perforated to allow access of the control media to the production zone.

Figure 2B:
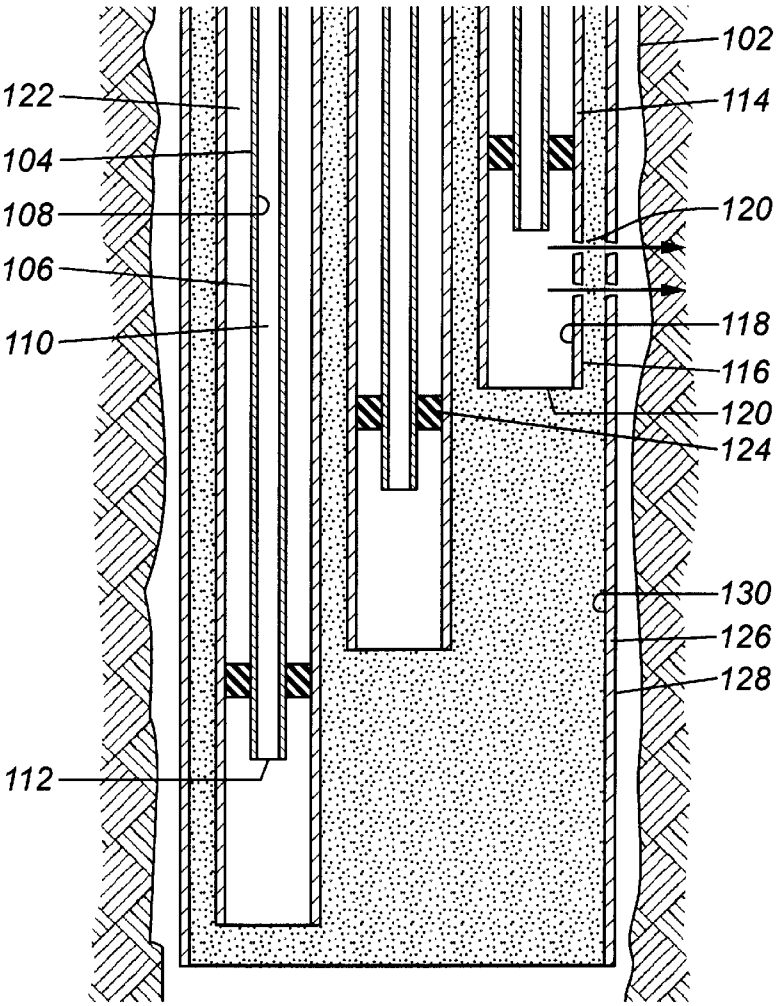
FIG. 2*b* shows a variation of the apparatus of FIG. 2*a*.
Figure 2A:
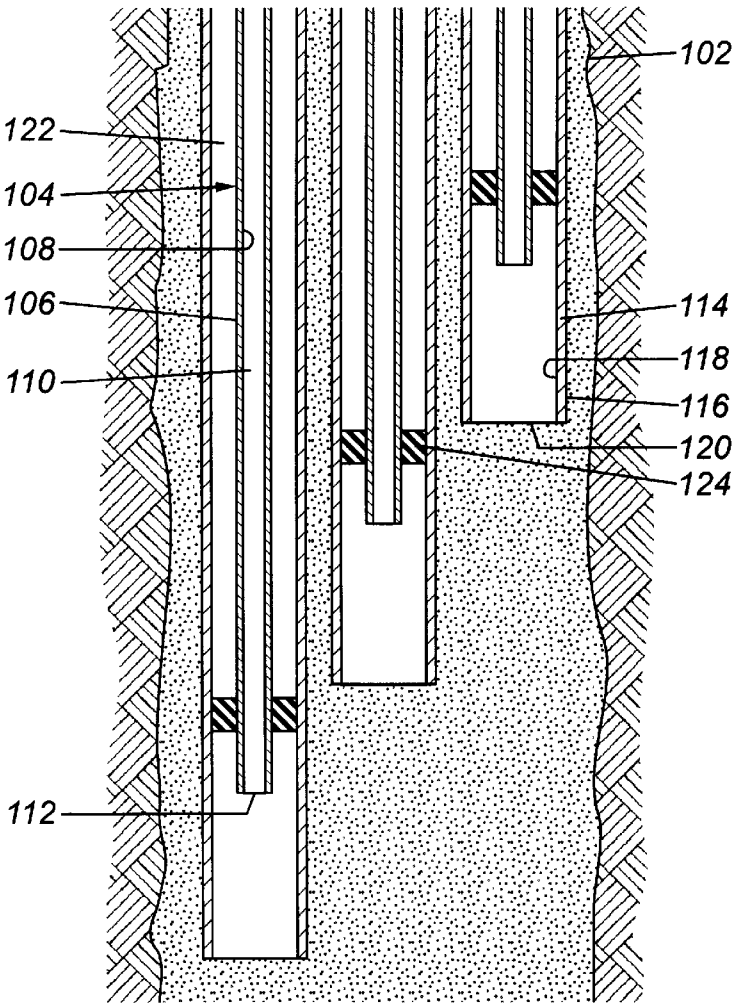
FIG. 2*a* is a cross-sectional view of another embodiment of an apparatus for multi-zone profile control of a well.

Referring now to FIGS. 2*a* and 2*b*, another embodiment is shown for an apparatus for multi-zone profile control in a well. The apparatus comprises a wellbore 102 intersecting at least one production zone, a plurality of first casing 114 within the wellbore, and a plurality of injection tubes 104.

Each first casing has an outside surface 116, an inside surface 118, at least one first control media exit 120, a bottom which may be closed, and a longitudinal axis parallel to a longitudinal axis of the wellbore. The casing may be simultaneously run into the wellbore, particularly if they are coiled tubing. This allows for a greater amount of casing to be positioned within a single wellbore than if the casing were run individually. Each injection tube has an outside surface 106, an inside surface 108 defining a injection annulus 110, at least one second control media exit 112, and a longitudinal axis parallel to the longitudinal axis of the wellbore. One injection tube is positioned within each first casing, thereby forming a plurality of casing/tubing pairs. Although shown scattered in the figure, the casing/tubing pairs could also all be the same length with control media exits placed adjacent to different production zones. For each casing/tubing pair the inside surface 118 of the first casing and the outside surface 106 of the injection tube define an insulation annulus 122. An insulation annulus surrounds each individual steam injection tube. This insulation annulus is filled with a first insulation media, such as air. At least one first zone isolation means 124 is placed within each insulation annulus 122 and positioned near at least one second control media exit 112 of the injection tube 104. The first isolation means is selected to prevent control media flow into the insulation annulus. A packer, nipple, or mandrel should function well.

At least one second control media exit of each injection tube is near at least one first control media exit of its paired first casing and both are adjacent to a production zone. Control media, such as steam, is injected through the injection annuluses of the injection tubes, the control media exiting the injection annuluses at at least one first and second control media exit, thereby having access into the production zone adjacent to the control media exits. As already described, the control media to all the zones can simultaneously be delivered and independently controlled at a different temperature and pressure for each zone.

When coiled tubing and casing is used, the injection tubes each have an outside diameter no greater than about 8.9 cm (3.5 inches), preferably no greater than about 5.1 cm (2 inches) and most preferably in the range of 2.5 to 3.2 cm (1–1¼ inch) and each casing has an outside diameter no greater than about 8.9 cm (3.5 inches), preferably 5.1 cm (2 inches).

A unique feature about this embodiment is that the wellbore need not be cased for the apparatus to have the proper insulation between injection tubes. Therefore, the embodiment is quite useful for a newly drilled injection well. However, the embodiment may also be used in a well which is cased, such as shown in FIG. 2*b*. In this variation a second casing 126 is within the wellbore, the second casing having an outside surface 128, an inside surface 130, and a longitudinal axis parallel to the longitudinal axis of the wellbore. The casing/tubing pairs are positioned within the second casing.

Figure 2C:
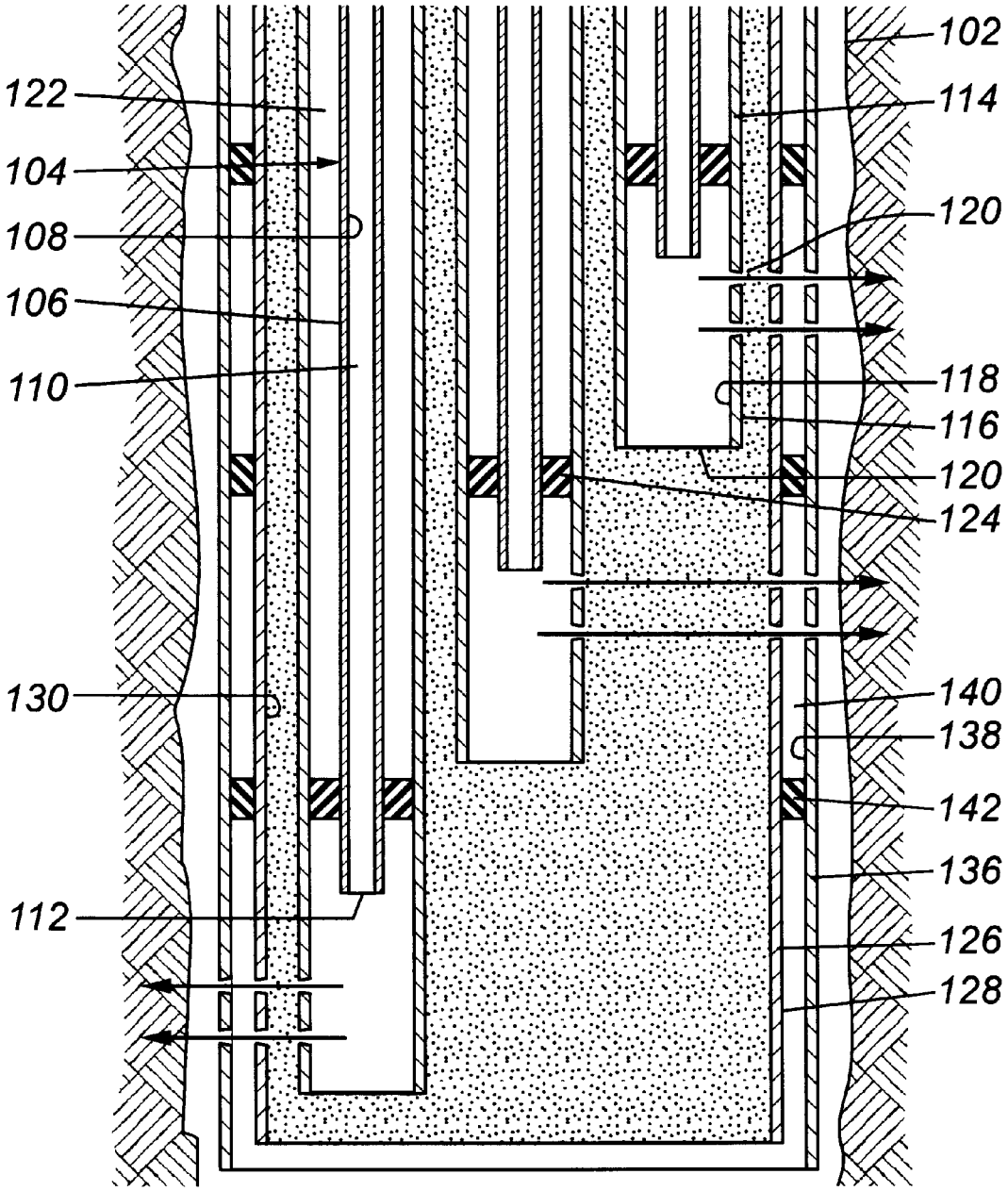
FIG. 2*c* shows a variation of the apparatus of FIG. 2*b*.

FIG. 2*c* shows a second variation on this embodiment, a version which can be used, as in the version of FIG. 2*b*, to convert an existing well to an injection well. Using the variation just described and shown in FIG. 2*b*, a third casing 136 is within the wellbore, the third casing having an inside surface 138, and a longitudinal axis parallel to the longitudinal axis of the wellbore. The third casing surrounds the second casing 126 whereby the inside surface 138 of the third casing and the outside surface 128 of the second casing define a casing annulus 140. A second insulation media, such as air, and a second zone isolation means 142 are within the casing annulus. The second zone isolation means is effective in sealing a production zone from other production zones. The second zone isolation means is selected from a plurality of packers, a plurality of nipples, a plurality of mandrels, or combinations thereof.

Figure 3:
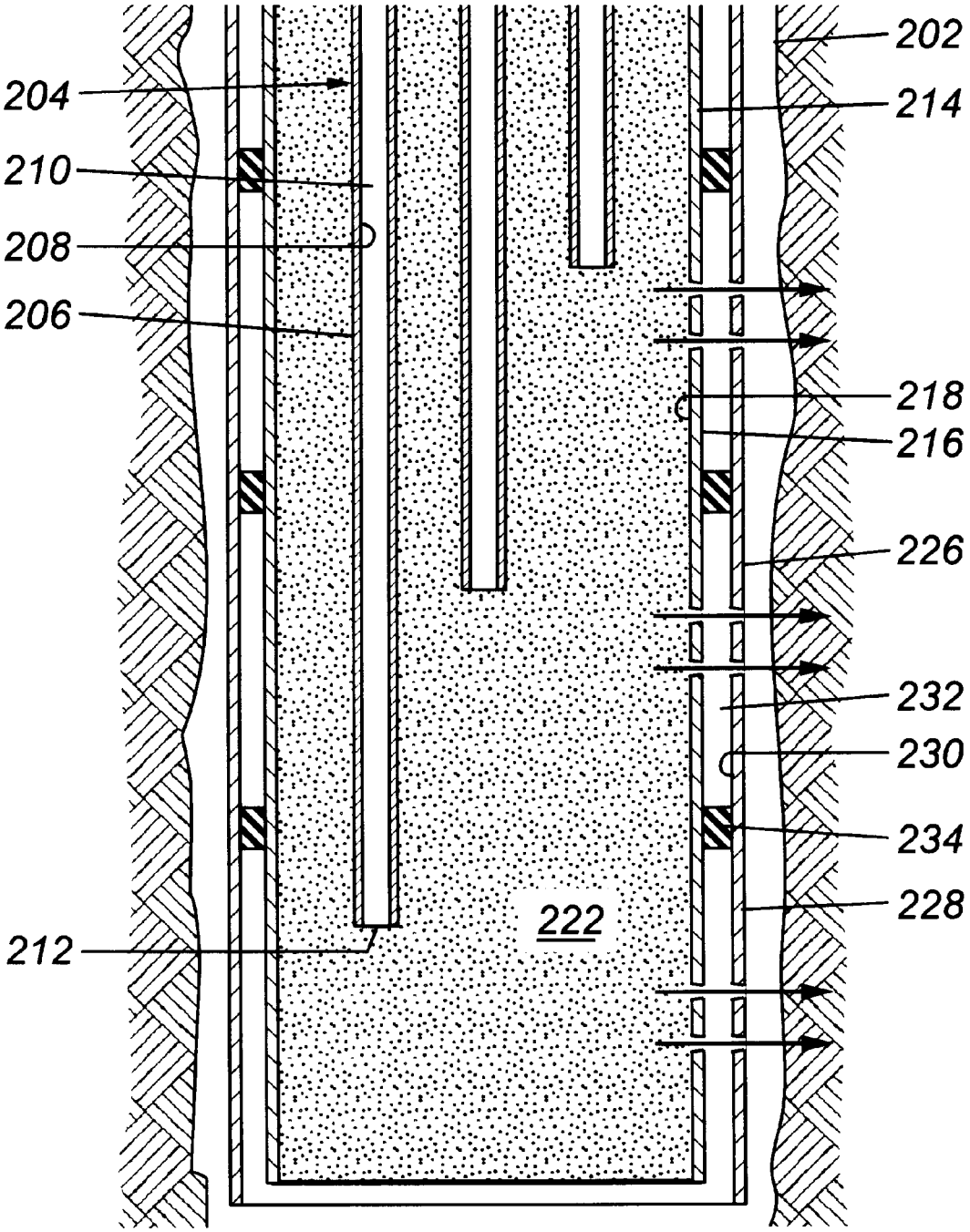
FIG. 3 is a cross-sectional view of an apparatus for multi-zone profile control of a well.

Referring to FIG. 3, yet another embodiment of the apparatus is shown for multi-zone profile control in a well. The apparatus comprises a wellbore 202 intersecting at least one production zone; a first casing 214 within the wellbore and having an outside surface 216, an inside surface 218 defining an insulation annulus 222, and a longitudinal axis parallel to a longitudinal axis of the wellbore; and a plurality of injection tubes 204 within the first casing 214, each the injection tube having an outside surface 206, an inside surface 208 defining a injection annulus 210, at least one control media exit 212 adjacent to a production zone, and a longitudinal axis parallel to the longitudinal axis of the first casing. Although shown scattered in the figure, the injection tubes could also all be the same length with control media exits placed adjacent to different production zones. The insulation annulus 222 is filled with an insulation media which surrounds the injection tubes 204. The insulation media is preferably low-conductivity cement or low-conductivity epoxy, which not only provides insulating properties but provides isolation between injection tubes.

As described above, the control media, such as steam, is injected through the injection annuluses of the injection tubes, the control media exiting the injection annuluses at at least one control media exit of the injection tubes. The control media has access into the production zone adjacent to the control media exit. The insulation media within the insulation annuluses allows simultaneous delivery of control media to each production zone, even when the control media to each zone is at a different temperature and pressure.

The plurality of injection tubes may be simultaneously run into the first casing, particularly if the injection tubes are coiled tubing. If coiled tubing is used, the injection tubes will have an outside diameter no greater than about 8.9 cm (3.5 inches).

The embodiment just described may further comprise a second casing 226 within the wellbore and surrounding the first casing 214. The second casing has an outside surface 228, an inside surface 230 and a longitudinal axis parallel to the longitudinal axis of the wellbore. The inside surface 230 of the second casing and the outside surface 216 of the first casing define a casing annulus 232. For production zone separation, a zone isolation means 234 is positioned in the casing annulus 232. This zone isolation means is selected from at least one packer, at least one nipple, at least one mandrel, or combinations thereof.

Figure 4B:
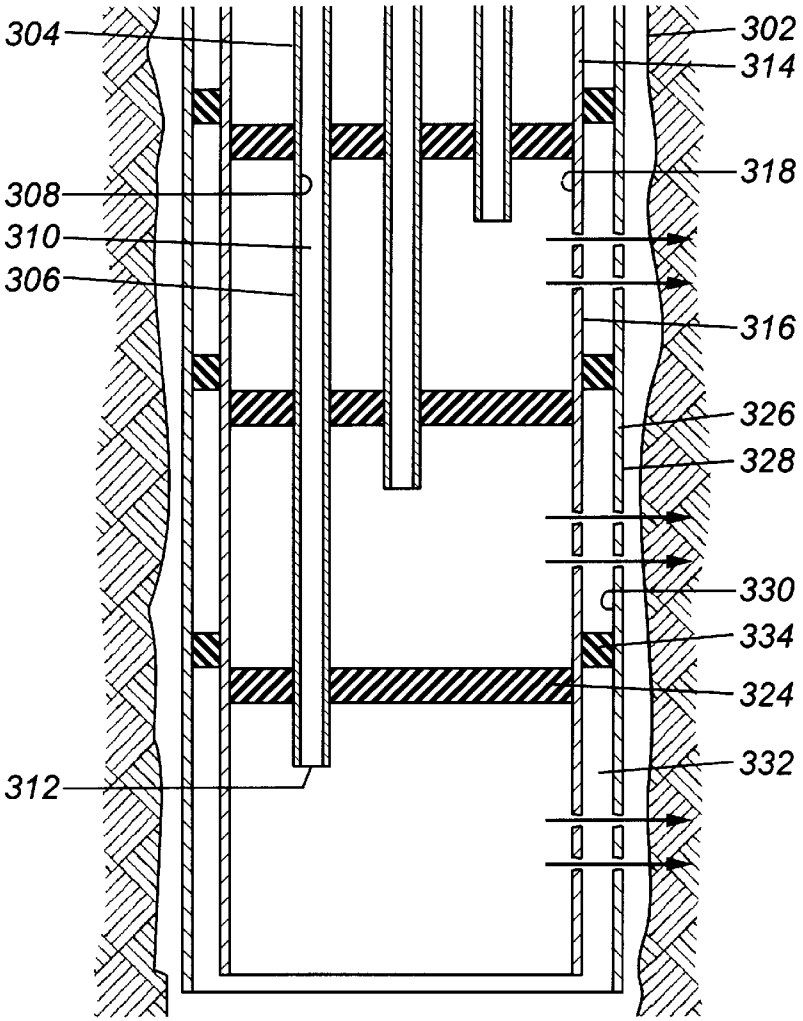
FIG. 4*b* shows a variation of the apparatus of FIG. 4*a*.
Figure 4A:
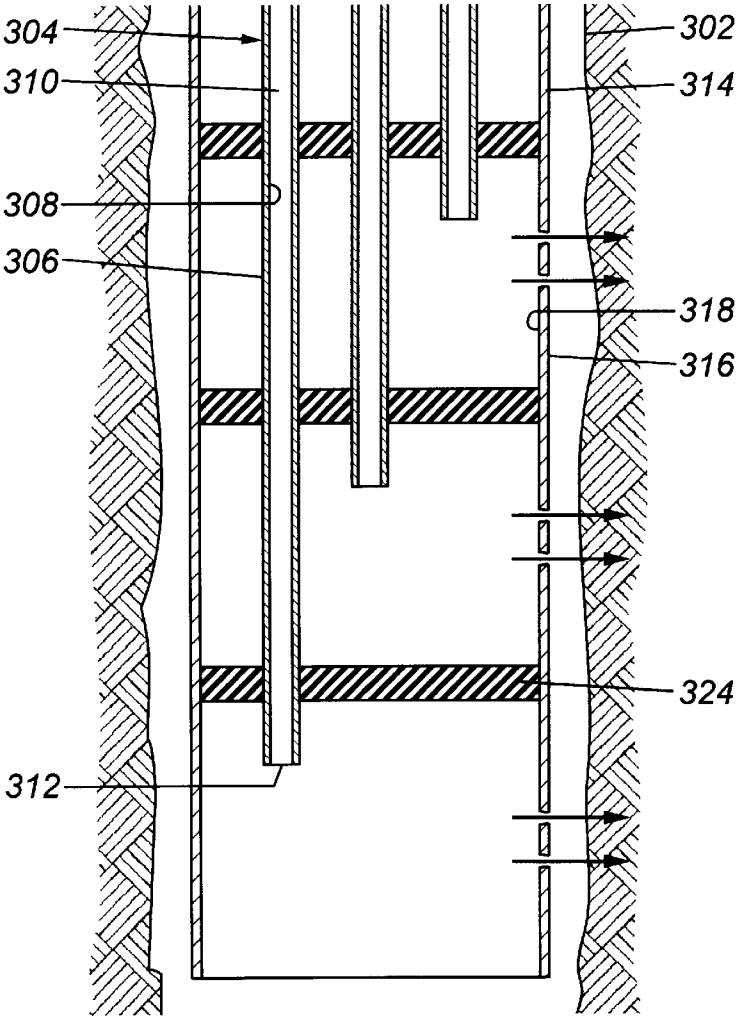
FIG. 4*a* is a cross-sectional view of yet another embodiment of an apparatus for multi-zone profile control of a well.

FIG. 4*a* shows yet another embodiment of the invention. The apparatus for multi-zone profile control in a well comprises a wellbore 302 intersecting at least one production zone; a first casing 314 inside the wellbore and having an outside surface 316, an inside surface 318, and a longitudinal axis parallel to a longitudinal axis of the wellbore; a plurality of injection tubes 304 within the first casing; a first zone isolation means 324 within the first casing which is effective in isolating production zones; and a first insulation media within the first casing. Each injection tube has an outside surface 306, an inside surface 308 defining a injection annulus 310, at least one control media exit 312 adjacent to a production zone, and a longitudinal axis parallel to the longitudinal axis of the first casing. Although shown scattered in the figure, the injection tubes could also all be the same length with control media exits placed adjacent to different production zones.

Control media, such as steam, is injected through the injection annulus of at least one of the injection tubes, the control media exiting the injection annulus at at least one control media exit of the injection tube. The control media has access to the production zone adjacent to the control media exit. The injection tubes may be simultaneously positioned into the first casing, particularly if they are coiled tubing. Coiled tubing injection tubes can have an outside diameter no greater than about 8.9 cm (3.5 inches).

As with the other embodiments, simultaneous delivery of control media at a different temperature and pressure through each injection tube is possible. The preferred insulation media is air. In order to isolate production zones, a plurality of packers, nipples, mandrels, or combinations thereof may be used where each packer or nipple or mandrel is positioned near at least one control media exit of an injection tube.

The embodiment of FIG. 4*a* just described is most useful for a newly drilled injection well. With only slight changes, the embodiment can also be used to convert an existing well to an injection well, as shown in FIG. 4*b*. This version comprises a second casing 326 having an outside surface 328, an inside surface 330, and a longitudinal axis parallel to the longitudinal axis of the wellbore, the second casing surrounding the first casing 314 whereby the inside surface 330 of the second casing and the outside surface 316 of the first casing define a casing annulus 332. A second zone isolation means 334 is located within the casing annulus 332, the second zone isolation means effective in isolating production zones. The second isolation means may be selected from a plurality of packers, a plurality of nipples, a plurality of mandrels, or a combination thereof In all embodiments just described the casing may need to be perforated to allow control media access to the production zone and the well may need to be fractured or refractured. The drilling engineer will be familiar with such procedures and know when they are necessary.

The present invention also provides a process singular and multi-zone profile control of a well. For singular zone control, a formation having a production zone is selected, along with a first wellbore which intersects the production zone, and a second wellbore which intersects the production zone. Control media, such as steam, is injected into the first wellbore through injection apparatus. The injection apparatus for single zone profile control is substantially as already described and shown in FIGS. 1*a* and 1*b*. The control media is passed through the injection apparatus into the production zones adjacent to each of the injection tubes. Should the embodiment of FIG. 1*a* be used in a newly drilled injection well, the casing 14 would need to be perforated, or similar, to provide the control media access to the production zone. The control media in the formation production zone acts as a driver, driving production fluids in the zone towards the second wellbore, where the fluids are recovered.

The process for multi-zone profile control is very similar, only the apparatus used is substantially as already described and shown in FIGS. 2*a*, or 3*a*, 3*b*, and 3*c*, or 4*a* and 4*b*. In addition, the multi-zone process allows for the simultaneous delivery of control media, such as steam, at a different pressure and temperature to each zone. By simultaneous delivery is meant that control media is passed through two or more injection tubes at the same time. This feature of the process allows the temperature and pressure of the control media to be uniquely tailored to the fluids in each zone.

In each multi-zone process described, with proper zone isolation means in place, it is possible to have a production zone producing in the first wellbore simultaneous with and independent of control media injection into other production zones.

The economic value of the apparatus and processes just described is seen in the following example. In looking at a steam injection application, a prior-art single commingled well is used as the baseline at a cost factor of 1. Estimated economic comparisons to the single commingled well are given in the Table. Estimated comparisons are given for new and conversion wells to be drilled in the same formation as the baseline well, where a conversion well is an existing well which is converted from a producer to an injector.

TABLE

Estimated Cost Factors for Steam Injection Completions

| Design | Type Completion | Number of Injection Tubes | Cost Factor |
|---|---|---|---|
| Single commingled | New | 1 | 1 |
| FIG. 1a | New | 1 | 0.63 |
| FIG. 1b | Conversion | 1 | 0.26 |
| FIG. 2a | New | 2 | 0.78 |
| FIG. 2b | Conversion | 2 | 0.31 |
| FIG. 2c | Conversion | 2 | 0.57 |
| FIG. 2a | New | 3 | 0.87 |
| FIG. 2b | Conversion | 3 | 0.40 |
| FIG. 2c | Conversion | 3 | 0.59 |
| FIG. 2a | New | 4 | 0.92 |
| FIG. 2b | Conversion | 4 | 0.45 |
| FIG. 2c | Conversion | 4 | 0.63 |
| FIG. 3 | New | 2 | 0.84 |
| FIG. 3 | Conversion | 2 | 0.36 |
| FIG. 3 | New | 3 | 0.94 |
| FIG. 3 | Conversion | 3 | 0.45 |
| FIG. 3 | New | 4 | 1.01 |
| FIG. 3 | Conversion | 4 | 0.53 |
| FIG. 4a | New | 2 | 0.76 |
| FIG. 4b | Conversion | 2 | 0.35 |
| FIG. 4a | New | 3 | 0.91 |
| FIG. 4b | Conversion | 3 | 0.53 |
| FIG. 4a | New | 4 | 1.03 |
| FIG. 4b | Conversion | 4 | 0.73 |

While this invention has been described in detail for the purposes of illustration, it is not to be construed as limited thereby but is intended to cover all changes and modifications within the spirit and scope thereof.

We claim:

1. An apparatus for zone profile control in a well, comprising:

a wellbore intersecting a production zone;

an injection tube within said wellbore, said injection tube having an outside surface, an inside surface defining a injection channel, at least one control media exit, and a longitudinal axis parallel to a longitudinal axis of the wellbore; and an insulation means having a longitudinal axis parallel to the longitudinal axis of the wellbore, said insulation means surrounding said injection tube;

wherein at least one control media exit of said injection tube is adjacent to said production zone; and wherein control media is injected through said injection channel, said control media exiting said injection channel at at least one control media exit of said injection tube, said control media further having access to the production zone.

2. An apparatus according to claim 1 wherein said insulation means comprises a first casing having an outside surface and an inside surface, wherein the inside surface of said first casing and the outside surface of said injection tube define an insulation annulus; and at least one first zone isolation means positioned within said insulation annulus near each at least one control media exit of said injection tube, said at least one first zone isolation means effective in preventing control media flow into the insulation annulus.

3. An apparatus according to claim 2 wherein each said at least one first zone isolation means is selected from a packer, a nipple, a mandrel, and combinations thereof.

4. An apparatus according to claim 2 wherein said injection tube is coiled tubing having an outside diameter no greater than about 8.9 cm (3.5 inches).

5. An apparatus according to claim 4 wherein said injection tube has an outside diameter no greater than about 5.1 cm (2 inches) and said first casing is coiled tubing having an outside diameter no greater than about 8.9 cm (3.5 inches).

6. An apparatus according to claim 2 wherein said insulation annulus is filled with air.

7. An apparatus according to claim 1 wherein said control media is steam.

8. An apparatus according to claim 2, further comprising a second casing within said wellbore, said second casing having an inside surface, and a longitudinal axis parallel to the longitudinal axis of the wellbore, wherein the inside surface of said second casing and the outside surface of said first casing define a casing annulus; and a second zone isolation means positioned in said casing annulus near at least one second control media exit of said first casing, said second zone isolation means effective in preventing flow of control media into said casing annulus;

wherein said first casing and said injection tube are within said second casing.

9. An apparatus according to 8 wherein said casing annulus is filled with cement.

10. An apparatus according to claim 8 wherein said injection tube is coiled tubing having an outside diameter no greater than about 8.9 cm (3.5 inches).

11. An apparatus according to claim 10 wherein said injection tube has an outside diameter no greater than about 5.1 cm (2 inches) and said first casing is coiled tubing having an outside diameter no greater than about 8.9 cm (3.5 inches).

12. An apparatus according to claim 8 wherein said second zone isolation means is selected from a packer, a nipple, a mandrel, and combinations thereof.

13. An apparatus for multi-zone profile control in a well, comprising:

a wellbore intersecting at least one production zone;

a plurality of first casing within said wellbore each said first casing having an outside surface, an inside surface at least one first control media exit, and a longitudinal axis parallel to a longitudinal axis of said wellbore;

a plurality of injection tubes, each said injection tube having an outside surface, an inside surface defining a injection channel, at least one second control media exit, and a longitudinal axis parallel to the longitudinal axis of said wellbore, wherein each injection tube is positioned within a first casing thereby forming a plurality of casing/tubing pairs whereby for each casing/tubing pair the inside surface of said first casing and the outside surface of said injection tube define an insulation annulus;

a first insulation media within each said insulation annulus; and at least one first zone isolation means within each said insulation annulus and positioned near each said at least one second control media exit of said injection tube, said at least one first zone isolation means effective in preventing control media flow into the insulation annulus;

wherein at least one second control media exit of each said injection tube is near at least one first control media exit of its paired first casing and adjacent to a production zone; and wherein control media is injected through the injection channel of at least one of said injection tubes, said control media exiting said injection channel at at least one first and second control media exits, said control media further having access to the production zone adjacent to said at least one first and second control media exits.

14. An apparatus according to claim 13 wherein said plurality of first casing are simultaneously positioned into said wellbore.

15. An apparatus according to claim 13 effective in allowing simultaneous delivery of control media at a different temperature and pressure through each injection tube.

16. An apparatus according to claim 13 wherein said control media is steam.

17. An apparatus according to claim 14 wherein said injection tubes are coiled tubing having an outside diameter no greater than about 8.9 cm (3.5 inches).

18. An apparatus according to claim 17 wherein said injection tube has an outside diameter no greater than about 5.1 cm (2 inches) and said first casing are coiled tubing having an outside diameter no greater than about 8.9 cm (3.5 inches).

19. An apparatus according to claim 13 wherein said first isolation means is selected from a packer, a nipple, a mandrel, and combinations thereof.

20. An apparatus according to claim 13 further comprising a second casing within said wellbore, said second casing having an outside surface, an inside surface, and a longitudinal axis parallel to the longitudinal axis of the wellbore;

wherein said casing/tubing pairs are within said second casing.

21. An apparatus according to claim 20 further comprising a third casing within said wellbore, said third casing having an inside surface, and a longitudinal axis parallel to the longitudinal axis of said wellbore, said third casing surrounding said second casing whereby the inside surface of said third casing and the outside surface of said second casing define a casing annulus;

a second insulation media within said casing annulus; and a second zone isolation means within said casing annulus, said second zone isolation means effective in sealing a production zone from other production zones.

22. An apparatus according to claim 21 wherein said first and second insulation media are air.

23. An apparatus according to claim 21 wherein said second zone isolation means is selected from a plurality of packers, a plurality of nipples, a plurality of mandrels, and combinations thereof.

24. An apparatus for multi-zone profile control in a well, comprising:

a wellbore intersecting at least one production zone;

a first casing within said first wellbore, said first casing having an outside surface, an inside surface defining an insulation annulus, and a longitudinal axis parallel to a longitudinal axis of said wellbore;

a plurality of injection tubes within said first casing, each said injection tube having an outside surface, an inside surface defining a injection channel, at least one control media exit adjacent to a production zone, and a longitudinal axis parallel to the longitudinal axis of said first casing; and an insulation media within said insulation annulus, said insulation media surrounding said injection tubes;

wherein control media is injected through the injection channel of at least one of said plurality of injection tubes, said control media exiting said injection channel at at least one control media exit of said at least one injection tube, said control media further having access to the production zone adjacent to said at least one control media exit.

25. An apparatus according to claim 24 wherein said plurality of injection tubes are simultaneously positioned into said first casing.

26. An apparatus according to claim 24 effective in allowing simultaneous delivery of control media at a different temperature and pressure through each injection tube.

27. An apparatus according to claim 24 wherein said control media is steam.

28. An apparatus according to 24 wherein said insulation media is selected from low-conductivity cement and low-conductivity epoxy.

29. An apparatus according to claim 25 wherein said injection tubes are coiled tubing having an outside diameter no greater than about 8.9 cm (3.5 inches).

30. An apparatus according to claim 29 wherein said injection tube has an outside diameter no greater than about 5.1 cm (2 inches) and said first casing is coiled tubing having an outside diameter no greater than about 8.9 cm (3.5 inches).

31. An apparatus according to claim 30 further comprising a second casing within said wellbore and surrounding said first casing, said second casing having an inside surface, and a longitudinal axis parallel to the longitudinal axis of the wellbore, wherein the inside surface of said second casing and the outside surface of said first casing define a casing annulus; and a zone isolation means positioned in said casing annulus, said zone isolation means effective in sealing a production zone from other production zones.

32. An apparatus according to claim 31 wherein said plurality of injection tubes are simultaneously positioned into said first casing.

33. An apparatus according to claim 31 effective in allowing simultaneous delivery of control media at a different temperature and pressure through each injection tube.

34. An apparatus according to claim 31 wherein said zone isolation means is selected from at least one packer, at least one nipple, at least one mandrel, and combinations thereof.

35. An apparatus according to 31 wherein said insulation media is selected from low-conductivity cement and low-conductivity epoxy.

36. An apparatus for multi-zone profile control in a well, comprising:

a wellbore intersecting at least one production zone;

a first casing inside said wellbore, said first casing having an outside surface, and inside surface, and a longitudinal axis parallel to a longitudinal axis of said wellbore;

a plurality of injection tubes within said first casings each said injection tube having an outside surface, an inside surface defining a injection channel, at least one control media exit adjacent to a production zone, and a longitudinal axis parallel to the longitudinal axis of said first casing;

at least one first zone isolation means within said first casing, said first zone isolation means effective in isolating production zones;

a first insulation media within said first casing;

wherein control media is injected through the injection channel of at least one of said injection tubes, said control media exiting said injection channel at at least one control media exit of said at least one injection tube, said control media further having access to the production zone adjacent to said at least one control media exit.

37. An apparatus according to claim 36 wherein said plurality of injection tubes are simultaneously positioned into said first casing.

38. An apparatus according to claim 36 effective in allowing simultaneous delivery of control media at a different temperature and pressure through each injection tube.

39. An apparatus according to claim 36 wherein said control media is steam.

40. An apparatus according to claim 36 wherein said at least one first zone isolation means is selected from a plurality of packers, a plurality of nipples, a plurality of mandrels, and combinations thereof, wherein each of said packer or nipple or mandrel is positioned near a control media exit of an injection tube.

41. An apparatus according to claim 36 wherein said first insulation media is air.

42. An apparatus according to claim 37 wherein said injection tubes are coiled tubing having an outside diameter no greater than 8.9 cm (3.5 inches).

43. An apparatus according to claim 42 wherein said injection tube has an outside diameter no greater than about 5.1 cm (2 inches) and said first casing is coiled tubing having an outside diameter no greater than 8.9 cm (3.5 inches).

44. An apparatus according to claim 36 further comprising a second casing having an inside surface, and a longitudinal axis parallel to the longitudinal axis of said wellbore, said second casing surrounding said first casing whereby the inside surface of said second casing and the outside surface of said first casing define a casing annulus; and a second zone isolation means within said casing annulus, said second zone isolation means effective in isolating production zones.

45. An apparatus according to claim 44 wherein said second zone isolation means is selected from a plurality of packers, a plurality of nipples, a plurality of mandrels, and a combination thereof.

46. A process for zone profile control of a well, comprising:

selecting a formation having a production zone;

selecting a first wellbore intersecting said production zone;

selecting a second wellbore intersecting said production zones;

injecting, control media into said first wellbore through injection apparatus, wherein said injection apparatus comprises a casing within said first wellbore, said casing having an inside surface, and a longitudinal axis parallel to a longitudinal axis of said first wellbore.

an injection tube within said casing, said injection tube having an outside surface an inside surface defining a injection channel, at least one control media exit adjacent to a production zone, and a longitudinal axis parallel to the longitudinal axis of the casing, wherein the inside surface of said casing and the outside surface of said injection tube define an insulation annulus and wherein said control media is carried in said injection channel and exiting at at least one control media exit, and at least one zone isolation means within said insulation annulus, each said zone isolation means effective in preventing control media flow into the insulation annulus;

passing said control media through said injection apparatus into the production zone; and recovering production fluids from said second wellbore.

47. A process according to claim 46 wherein said injection tube is coiled tubing having an outside diameter no greater than about 8.9 cm (3.5 inches).

48. A process according to claim 47 wherein said injection tube has an outside diameter no greater than about 5.1 cm (2 inches) and said casing is coiled tubing having an outside diameter no greater than about 8.9 cm (3.5 inches).

49. A process according to claim 46 wherein said insulation annulus is filled with air.

50. A process according to claim 46 wherein said control media is steam.

51. A process for multi-zone profile control of a well, comprising:

selecting a formation having at least one production zone;

selecting a first wellbore intersecting at least one of said at least one production zones;

selecting a second wellbore intersecting at least one of said at least one production zones;

injecting control media into said first wellbore through injection apparatus, wherein said injection apparatus comprises a plurality of casing within said first wellbore, each said casing having an inside surface, at least one first control media exit, and a longitudinal axis parallel to a longitudinal axis of said first wellbore, a plurality of injection tubes, each said injection tube having an outside surface, an inside surface defining a injection channel, at least one second control media exit, and a longitudinal axis parallel to the longitudinal axis of said first wellbore, wherein said control media is carried in said injection channel and exiting at at least one second control media exit wherein each injection tube is positioned within a casing thereby forming a plurality of casing/tubing pairs whereby for each casing/tubing pair the inside surface of said casing and the outside surface of said injection tube define an insulation annulus, wherein at least one second control media exit of each said injection tube is near at least one first control media exit of its paired casing and adjacent to a production zone, an insulation media within each said insulation annulus, and at least one zone isolation means within each said insulation annulus, each said zone isolation means effective in preventing control media flow into the insulation annulus;

passing said control media through said injection apparatus into the production zones adjacent to each of said injection tubes; and recovering production fluids from said second wellbore.

52. A process according to claim 51 further comprising allowing simultaneous injection of said control media at a different temperature and pressure through each injection tube.

53. A process according to 51 wherein said insulation media is air.

54. A process according to claim 51 wherein said injection tubes are coiled tubing having an outside diameter no greater than about 8.9 cm (3.5 inches).

55. A process according to claim 54 wherein said injection tube has an outside diameter no greater than about 5.1 cm (2 inches) and said casing is coiled tubing having an outside diameter no greater than about 8.9 cm (5 inches) and wherein said plurality of casing are simultaneously positioned in said first wellbore.

56. A process according to 51 wherein at least one production zone is producing in said first wellbore while control media is injected into at least one other production zone.

57. A process for multi-zone profile control of a well, comprising:

selecting a formation having at least one production zone;

selecting a first wellbore intersecting at least one of said at least one production zone;

selecting a second wellbore intersecting at least one of said at least one production zones;

injecting control media into said first wellbore through injection apparatus, wherein said injection apparatus comprises a casing within said first wellbore, said casing having an inside surface defining an insulation annulus, and a longitudinal axis parallel to a longitudinal axis of said first wellbore, a plurality of injection tubes within said casing, each said injection tube having an outside surface, an inside surface defining a injection channel, at least one control media exit adjacent to a production zone, and a longitudinal axis parallel to the longitudinal axis of said casing, wherein said control media is carried in said injection channel and exiting at at least one control media exit, an insulation media within said insulation annulus, said insulation media surrounding said injection tubes, and a plurality of zone isolation means effective in isolating production zones;

passing said control media through said injection apparatus into the production zones adjacent to each of said at least one control media exits; and recovering production fluids from said second wellbore.

58. A process according to claim 57 further comprising allowing simultaneous injection of said control media at a different temperature and pressure through each injection tube.

59. A process according to claim 57 wherein said injection tubes are coiled tubing having an outside diameter no greater than about 8.9 cm (3.5 inches) and wherein said plurality of injection tubes are simultaneously positioned in said casing.

60. A process according to claim 59 wherein said injection tube has an outside diameter no greater than about 5.1 cm (2 inches) and said casing is coiled tubing having an outside diameter no greater than about 8.9 cm (5 inches).

61. A process according to 57 wherein said insulation media is selected from low-conductivity cement, low conductivity epoxy, and air.

62. A process according to 57 wherein at least one production zone is producing in said first wellbore while control media is injected into at least one other production zone.

* * * * *